United States Patent [19]

Dodenhoff

[11] 3,988,053

[45] Oct. 26, 1976

[54] HERMETIC TERMINAL

[76] Inventor: John A. Dodenhoff, 136 East Hill Drive, Cranston, R.I. 02920

[22] Filed: Jan. 20, 1975

[21] Appl. No.: 542,413

[52] U.S. Cl. ..... 339/278 C; 174/152 GM; 428/432

[51] Int. Cl.[2] ..... H01R 13/52

[58] Field of Search ..... 339/94, 192, 276, 278; 174/50.61, 152 GM; 428/432–434

[56] References Cited

UNITED STATES PATENTS

| | | | |
|---|---|---|---|
| 2,174,682 | 10/1939 | Beggs | 174/50.61 |
| 2,450,780 | 10/1948 | Bucklen | 174/152 GM |
| 2,949,376 | 8/1960 | Comer | 174/152 GM |
| 2,968,020 | 1/1961 | Barnhart | 339/192 R |
| 3,007,130 | 10/1961 | Martin | 339/275 R |
| 3,373,322 | 3/1968 | Hillman et al. | 174/50.61 |
| 3,551,191 | 12/1970 | Elbling et al. | 174/152 GM |
| 3,637,917 | 1/1972 | Oates | 174/152 GM |

FOREIGN PATENTS OR APPLICATIONS

| | | | |
|---|---|---|---|
| 523,390 | 4/1956 | Canada | 174/152 GM |

*Primary Examiner*—Joseph H. McGlynn
*Attorney, Agent, or Firm*—Salter & Michaelson

[57] ABSTRACT

A hermetic terminal comprising a metallic wall having at least one opening therein through which a conductor pin extends, said pin being secured in said opening by means of a glass-to-metal seal, said pin comprising three distinct sections, namely, a first section of any suitable electrically conductive material, such as cold rolled steel, a second intermediate section of a sealing alloy, such as stainless steel or a nickel-iron alloy, and a third section of a highly conductive, corrosion-resistant metal, such as copper. The intermediate section of the pin, i.e., the sealing alloy, contacts the glass in the aforesaid glass-to-metal seal with the copper section of the pin extending in one direction from the metallic wall and the cold rolled steel section of the pin extending in the opposite direction therefrom.

12 Claims, 4 Drawing Figures

HERMETIC TERMINAL

BACKGROUND AND SUMMARY OF THE INVENTION

The present invention relates to hermetic terminals, and more particularly to hermetic compressor terminals of the type used in air conditioners, refrigerators, and the like. This type of terminal is used to carry electrical current into a hermetically enclosed compressor to run the motor in any type of electrical cooling system.

Terminals of this general type are well known in the art, and examples of same are illustrated in Wyzenbeek U.S. Pat. No. 3,160,460 dated Dec. 8, 1964, and Elbling et al. U.S. Pat. No. 3,551,191 dated Dec. 29, 1970. Terminals of this type traditionally comprise a generally cup-shaped metallic body having a plurality of openings in the end wall of the body, through each of which a conductor pin extends, the pin being hermetically sealed to the body by means of a glass-to-metal seal.

The aforesaid conductor pins have traditionally been constructed of No. 446 stainless steel for a number of reasons. First of all, in order to provide an effective glass-to-metal seal, it is necessary that the coefficient of thermal expansion of the pin relate properly with the coefficient of thermal expansion of the glass, since if the coefficients do not properly relate, then proper sealing between the pin and the glass cannot be achieved. The coefficient of thermal expansion of No. 446 stainless steel is such that an effective glass-to-metal seal can be achieved, although it will be understood that there are other materials, such as a nickel-iron alloy, which also permit effective sealing to glass.

Another desirable feature of stainless steel is that it is corrosion resistant, it being understood that in hermetic compressor terminals of the type with which the present invention is concerned, one end of the conductor pins will be extending outside of the enclosure housing the compressor, and in many cases will be exposed to the outside, whereby corrosion of the exposed ends becomes a possibility if the conductor pins are not constructed of a corrosion-resistant material. It will be understood that it is the usual practice to weld tabs or spades to the exposed outer ends of the conductor pins, which tabs or spades are adapted to receive terminals clips carried by the wiring which extends from the source of electrical power. Thus, the electrical current is transmitted from the wiring to the conductor pins by means of the mechanical interconnection which exists between the terminal clips and the conductabs or spades. The current then passes throuugh the conductor pins into the enclosure, said pins being connected at their inner ends to the terminals of the compressor by any suitable means, such as the means shown in the aforesaid Wyzenbeek patent. It will be understood that stainless steel is a sufficiently good conductor of electricity so as to make its use desirable for that reason as well.

The problem with the aforesaid stainless steel conductor pins is primarily the high material cost of stainless steel, plus its limited current-carrying capacity for higher power applications. In such high-power applications, copper-core stainless steel may be effectively used, but is extremely expensive. In addition, the assembly of the conductor tabs or spades to the exposed outer ends of the conductor pins is costly; and it has been further found that the securement of the aforesaid conductor tabs or spades to the conductor pins may reuslt in some reduction of electrical conductivity of the overall assembly.

The present invention is directed to the provision of a novel and unique conductor pin for hermetic compressor terminals and the like wherein the pin comprises three distinct sections secured to each other in tandem. More specifically, the conductor pin of the present invention comprises a first section of any suitable electriclly conductive material, such as cold rolled steel, a second intermediate section constructed of a material having a coefficient of thermal expansion such as to permit effective sealing with glass, and a third section constructed of a highly conductive, corrosion-resistant material, such as copper. The intermediate section, which may be stainless steel or a nickel-iron alloy, constitutes the portion of the pin that is sealed to the glass. The cold rolled steel section of the pin extends inwardly into the compressor housing, while the copper section of the pin extends outwardly of the terminal for receiving the wiring from the outside source of electricity. As a further feature of the present invention, the exposed copper sections of the pins are cold formed so as to assume a flattened configuration adjacent their outer ends, which flattened portions are adapted to receive a conventional terminal clip. It will be understood that where the entire conductor pin is constructed of stainless steel it is not economically feasible to flatten the ends, whereas it is feasible to do so with the softer copper material. It will be seen that by flattening the exposed copper ends of the pins, said flattened portions function as the conductor tab or spade, hence eliminating the necessity of welding separate tabs or spades to the ends of the pins, as must be done where the pins are conducted of stainless steel.

It has been found that the cost of providing the three-section conductor pin of the present invention, including the cost of flattening the copper ends thereof, approximately equals the cost of making the entire conductor pin of stainless steel and then welding thereof a separate cold rolled steel tab or spade. In other words, the lower overall material costs of the conductor pin of the present invention, and the omission of a separate conductor tab or spade and securement of same to the pin, cancels out the costs involved in fabricating the three-section pin and flattening the end thereof, whereby the end result, from a cost standpoint, is a conductor pin comparable to that used in the prior art, i.e., a sold stainless steel pin with a separate cold rolled steel tab or spade welded to the outer end thereof. On the other hand, it has been found that the conductor pin of the present invention results in better electrical conductivity than the prior art, since the cold rolled steel tabs or spades conventionally welded to the exposed outer ends of the conventional stainless steel pins are subject to corrosion, which, of course, results in a reduction of electrical conductivity. Even without such corrosion, it has been found that the electrical conductiveity of the conductor pin of the present invention, wherein separate conductor tabs and spades are eliminated, and wherein a portion of the pin is of highly conductive copper, is appreciably better than the electrical conductivity of the solid stainless steel conductor pin having the separate tab or spade welded thereto.

Other objects, features and advantages of the present invention will become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 3:
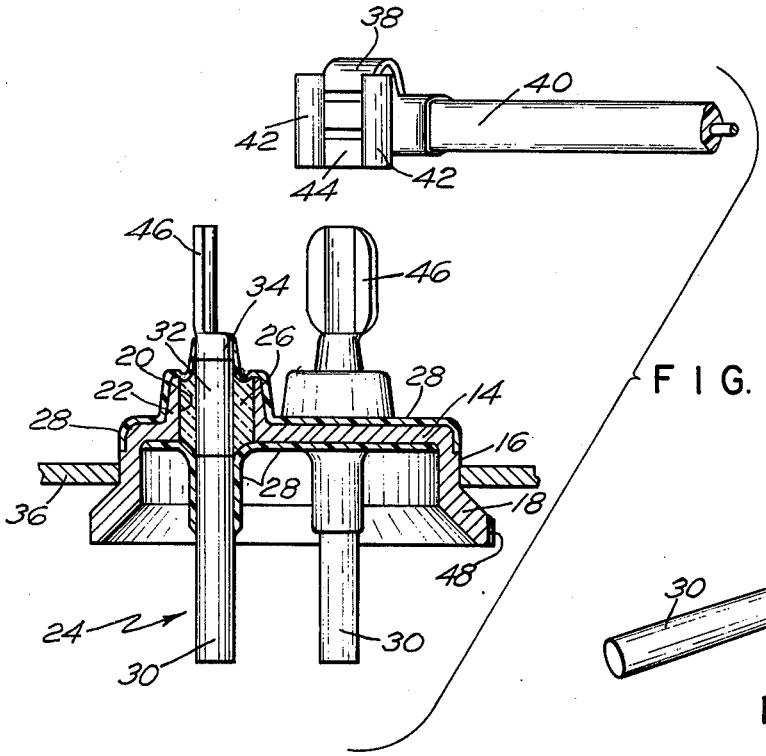
FIG. 3 is a section taken on line 3—3 of FIG. 2 but also showing the type of terminal clip adapted to be associated with the present invention.

Referring now to the drawings, there is shown generally at 10 a hermetic compressor terminal constructed in accordance with the present invention and comprising a metallic body 12 having an end wall 14 and a peripheral side wall 16 terminating in an outwardly flared lip 18. A plurality of openings 20 extend through end wall 14, and surrounding each said opening is a collar or extrusion 22 struck integrally from end wall 14 and extending outwardly therefrom, although in many cases the extrusion 22 extends inwardly, i.e., in the same direction as wall 16. A conductor pin shown generally at 24 extends through each opening and is hermetically secured and sealed to terminal 10 by means of a glass-to-metal seal 26 fused within the confines of opening 20 and collar 22. A conventional insulating epoxy 28 is coated over the inner and outer surfaces of end wall 14, as illustrated most clearly in FIG. 3, said coating serving to space the exposed ends of pin 24 sufficiently from the nearest electrically conductive surface to meet the minimum over surface and through-air electrical requirements, all in a manner well known in the art. In addition to performing this function, the coating 28 also protects the relatively brittle glass 26 from physical damage and at the same time provides corrosion-resistant means for the exposed outer surface of end wall 14, since the body 12 is conventionally constructed of a corrosible material, such as cold rolled steel.

Figure 4:
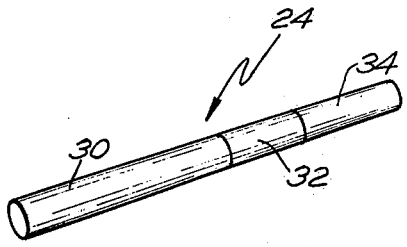
FIG. 4 is a perspective detail view of the conductor pin per se which forms a part of the present invention.

Referring to FIG. 4, it will be seen that conductor pin 24 comprises three distinct sections secured to each other in tandem by any suitable means, such as brazing, fusing, or the like. More specifically, pin 24 comprises a first section 30 which is constructed of any suitable electrically conductive material; a second intermediate section 32 constructed of a suitable sealing alloy, and a third section 34 constructed of a highly conductive, corrosion-resistant material, such as an oxygen-free, high conductivity copper. It will be understood that the term "sealing alloy" as used herein means a material having a coefficient of thermal expansion sufficiently similar to the coefficient of thermal expansion of glass 26 so as to permit effective sealing therewith, it being noted in FIG. 3 that the intermediate section 32 of pin 24 constitutes the portion of the pin that is in engagement with and is sealed to glass 26. Examples of suitable seling alloys are stainless steel and a conventional nickel-iron alloy. It will be further understood that the specific material of which section 30 is constructed is dictated by the current-carrying requirements of the particular application involved. In normal situations, cold rolled steel is satisfactory, and since this is a relatively inexpensive material, it is used wherever possible. Where, however, high current-carrying applications are involved, the section 30 may be copper-clad cold rolled steel, or even copper per se, although either such material substantially increases the cost of the overall pin. Where low current carrying requirements are present, it might even be possible to use brass for the section 30.

In use, the terminal 10 will be secured in an enclosure 36 whereby electrical current may pass from outside said enclosure to the inside thereof while at the same time maintaining said enclosure hermetically sealed. The sections 30 of pins 24 extend into the confines of enclosure 36 and then make electrical connection with the compressor or the like located therein by any suitable means, not shown. The opposite ends of pins 24, namely, sections 34, extend outwardly of enclosure 36; and since in many cases said sections may be exposed to the outside atmosphere, it is important that said exposed sections be corrosion resistant. Since, however, the exposed sections 34 are specifically constructed of a corrosion-resistant material, such as an oxygen-free copper, it will readily be seen that the requirement of being corrosion resistant is met. Since the sections 30 of pins 24 are housed within enclosure 36, no corrosion problem is present, and hence these sections may be constructed of a less expensive material, such as cold rolled steel, where normal current-carrying requirements exist. The intermediate sections 32 are specifically provided in order to permit the pins 24 to be effectively sealed to the glass 26, as aforedescribed.

As hereinbefore stated, where the conductor pins are constructed of stainless steel, the conventional practice has been to weld a separate tab or spade to the exposed outer ends of the pins to slidingly and frictionally receive a conventional terminal clip 38 carried by electrical wiring 40 which it will be understood extends to the outside source of electrical power. Specifically, the clip 38 is provided with oppositely disposed rolled portins 42, the inner edges of which are spaced from plate portion 44 whereby the clip 38 may slidingly engage a flat tab so as to frictionally grip thereon. In the present invention, the section 34 of pin 24, being of a relatively soft material such as copper, may be cold formed so as to assume a flattened configuration, as shown at 46, whereby said integral flattened portion functions as the tab or spade which slidingly receives clip 38 so as to make electrical interconnection therewith. It will be noted (see FIG. 2) that the tabs 46 are formed on the outside edges of their respective pins, so as to afford maximum spacing between the terminal clips connected thereto. Thus, it will be seen that the necessity of providing and securing a separate tab or spade has been completely eliminated. By the same token, since the separate tab or spade conventionally used in the prior art was normally constructed of a material such as cold rolled steel, the possibility of corrosion was always present, which possibility has now been eliminated, since the entire exposed portion of pin 24, namely, section 34, is of corrosion-resistant material, and no separate corrodable tab or spade is present.

If a situation should arise where it becomes necessary or desirable to provide clip-receiving tabs 46 at both ends of pin 24, then it will be understood that section 30 would then also be constructed of copper to permit cold forming thereof.

Figure 1:
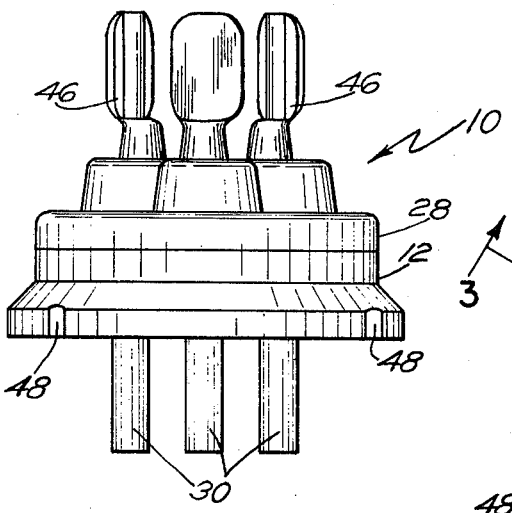
FIG. 1 is a side elevational view of a hermetic terminal constructed in accordance with the present invention.
Figure 2:
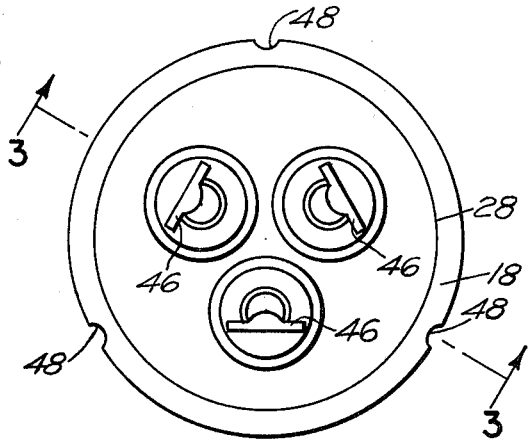
FIG. 2 is a top plan view thereof.

In order to facilitate proper alignment of the terminal 10 components when the parts are being mounted in the fusing fixture which holds the body and the pins during the glass fusing operation, alignment means in the form of spaced notches 48 are provided at the outer edges of lip 18, as shown most clearly in FIGS. 1 and 2.

While there is shown and described herein certain specific structure embodying the invention, it will be manifest to those skilled in the art that various modifications and rearrangements of the parts may be made without departing form the spirit and scope of the underlying inventive concept and that the same is not limited to the particular forms herein shown and described except insofar as indicated by the scope of the appended claims.

When is claimed is:

1. A hermetic terminal of the type used for carrying electrical current into a hermetically enclosed compressor and wherein the end of said terminal located outside the compressor is normally exposed to the atmosphere, said terminal comprising a metallic wall having an opening therein, a conductor pin extending through said opening said insulated from and secured to said wall by a glass-to-metal seal, said pin comprising three solid cylindrical sections each constructed of a different material and each having substantially the same outer diameter, said sections connected to each other in tandem so as to provide an elongated, three-section pin having a substantially smooth, uninterrupted outer surface, the section of said pin located at the end adapted to be positioned within the compressor being constructed of any suitable electrically conducting material capable of meeting the current-carrying requirements of the terminal, the section of the pin located at the other end and adapted to be exposed to the atmosphere being constructed of an electrically conductive, corrosion-resistant metal, and the intermediate section being constructed of a sealing alloy and being in sealing contact with said glass-to-metal seal.

2. In the terminal of claim 1, said sealing alloy consisting of a nickel-iron alloy.

3. In the terminal of claim 1, said sealing alloy consisting of stainless steel.

4. In the terminal of claim 1, said suitable electrically conductive material being cold rolled steel.

5. In the terminal of claim 1, said electrically conductive, corrosion-resistant metal being copper.

6. In the terminal of claim 5, said copper section having a flattened portion adjacent its extremity adapted to receive a terminal clip.

7. A conductor pin for a hermetic termial comprising three solid cylindrical sections each constructed of a different material and each having substantially the same outer diameter, said sections connected to each other in tandem so as to provide an elongated, three-section pin having a substantially smooth, uninterrupted outer surface, one end section of the pin being constructed of any suitable electrically conducting material capable of meeting the current-carrying requirements of the terminal, the other end section of the pin being constructed of an electrically conductive, corrosion-resistant metal, and the intermediate section being constructed of a sealing alloy.

8. In the conductor pin of claim 7, said sealing alloy consisting of nickel-iron alloy.

9. In the conductor pin of claim 7, said sealing alloy consisting of stainless steel.

10. In the conductor pin of claim 7, said suitable electrically conductive material being cold rolled steel.

11. In the conductor pin of claim 7, said electrically conductive, corrosion-resistant metal being copper.

12. In the conductor pin of claim 11, said copper section having a flattened portion adjacent its extremity adapted to receive a terminal clip.

* * * * *